US011607596B2

(12) United States Patent
Hardin

(10) Patent No.: US 11,607,596 B2
(45) Date of Patent: Mar. 21, 2023

(54) POCKET-SIZED NON-INFLATABLE BOXING BAG DUALLY USABLE AS AN ADVERTISING FLYER

(71) Applicant: Albert Hardin, Euclid, OH (US)

(72) Inventor: Albert Hardin, Euclid, OH (US)

( * ) Notice: Subject to any disclaimer, the term of this patent is extended or adjusted under 35 U.S.C. 154(b) by 153 days.

(21) Appl. No.: 17/060,822

(22) Filed: Oct. 1, 2020

(65) Prior Publication Data

US 2021/0101064 A1 Apr. 8, 2021

Related U.S. Application Data

(60) Provisional application No. 62/910,753, filed on Oct. 4, 2019.

(51) Int. Cl.

| | |
|---|---|
| ***A63B 69/20*** | (2006.01) |
| ***G09F 23/00*** | (2006.01) |
| ***A63B 21/008*** | (2006.01) |

(52) U.S. Cl.

CPC ..... *A63B 69/20* (2013.01); *A63B 21/0088* (2013.01); *G09F 23/0066* (2013.01); *A63B 2209/00* (2013.01); *A63B 2210/50* (2013.01); *A63B 2210/54* (2013.01); *A63B 2244/102* (2013.01)

(58) Field of Classification Search

CPC . A63B 21/0084; A63B 21/0088; A63B 69/24; A63B 69/26; A63B 69/32; A63B 69/325; A63B 2209/00; A63B 2210/50; A63B 2210/54; A63B 2244/102; A63B 69/20–34

See application file for complete search history.

(56) References Cited

U.S. PATENT DOCUMENTS

| | | | | |
|---|---|---|---|---|
| 5,472,394 | A * | 12/1995 | Michaelson | A63B 23/047 482/111 |
| 5,803,838 | A * | 9/1998 | DeMarini | A63B 21/0088 473/437 |
| 2011/0160004 | A1* | 6/2011 | Imatoh | A63B 21/0088 473/422 |
| 2012/0015783 | A1* | 1/2012 | Brown | A63B 21/4009 482/74 |
| 2013/0337980 | A1* | 12/2013 | Himmelrick | A63B 21/072 482/108 |

FOREIGN PATENT DOCUMENTS

| | | | | |
|---|---|---|---|---|
| WO | WO-2006117827 | A1 * | 11/2006 | A63B 69/12 |
| WO | WO-2012122591 | A1 * | 9/2012 | A63B 21/00069 |

* cited by examiner

*Primary Examiner* — Jennifer Robertson

(74) *Attorney, Agent, or Firm* — Daugherty & Del Zoppo, Co. LPA

(57) ABSTRACT

Aspects provide a punching bag formed by a body panel with a first edge that forms a first closed end, and a second edge distal to the first that defines a second opened end of an interior enclosure of the punching bag that is bounded within interior surface sidewalls of the body panel between the first closed end and the second opened end. The first closed end traps air within the interior enclosure that is configured to interact via the second opened end with ambient air within an outer area surrounding the body panel, to thereby slow motion of the punching bag as it is conveyed through the ambient air in response to forces imparted to the bag body panel by a user.

8 Claims, 4 Drawing Sheets

POCKET-SIZED NON-INFLATABLE BOXING BAG DUALLY USABLE AS AN ADVERTISING FLYER

BACKGROUND

The art of boxing has existed prior to 2014. It is a highly recognizable sport and exercise. In connection to its years of existing there are several (other) boxing/punching bags and devices related that have been patented.

Traditional boxing bags have required installation by the user and/or the injection of air, water or sand into the said boxing bag to be operated by the user.

U.S. Pat. No. 825,860 filed Mar. 13, 1906 by Charles McKenzie. An example of a boxing ball fixed to other devices to be operable.

U.S. Pat. No. 6,217,489 B1 filed Aug. 22, 1997 by Robert Steven Nicholson. An example of a supported boxing bag requiring installation before operation.

U.S. Pat. No. 6,027,435 filed Dec. 30, 1988 by Benjamin Nadorf, Alan Weck and William Bambrough. An example of a free standing punching bag mounted on a pedestal.

U.S. Pat. No. 8,574,135 B2 flied Oct. 11, 2011 by Yi Yi Chen. An example of a boxing ball with attachments in order to be operable.

BRIEF SUMMARY

Aspects provide a punching bag formed by a body panel with a first edge joined at one edge to form a first closed end, and a second edge distal to the first that defines a second opened end of an interior enclosure of the punching bag that is bounded within interior surface sidewalls of the body panel between the first closed end and the second opened end. The first closed end traps air within the interior enclosure that is configured to interact via the second opened end with ambient air within an outer area surrounding the body panel, to thereby slow motion of the punching bag as it is conveyed through the ambient air in response to forces imparted to the bag body panel by a user.

BRIEF DESCRIPTION OF THE SEVERAL VIEWS OF THE DRAWINGS

These and other features of this invention will be more readily understood from the following detailed description of the various aspects of the invention taken in conjunction with the accompanying drawings in which.

DETAILED DESCRIPTION

Aspects of the present invention provide for a non-inflatable boxing bag not supported by chains, cords, nor attachments to either side. The objective is to provide the user with a boxing/punching bag that is truly free from needing to be installed. An additional objective is to provide the user with a boxing/training bag that is not restricted to back-and-forth and/or up and down movements. Moreover another objective is to provide the user with a boxing/punching bag that can be easily folded and placed into the user's pocket for easy transport.

As an alternative objective the user can use the boxing/punching bag as an advertising flyer.

An embodiment includes a closed top (no attachments needed) and an opened bottom (no valves for air injection) and several vents/scorings near the bottom to allow natural airflow when being struck by the user's foot, head, hand, knee, and/or elbow during training. Unlike other boxing/punching bags, aspects of the present invention can be pulled out of a drawer, pocket, or gym bag then tossed into the air by the user for immediate use; challenging the user's hand-and-eye coordination, ability to control punches and punch consistency. Natural gravity and interaction from the user keeps the boxing/punching bag air-borne during use. When the user stops interacting with the boxing/punching bag it descends.

Figure 1:
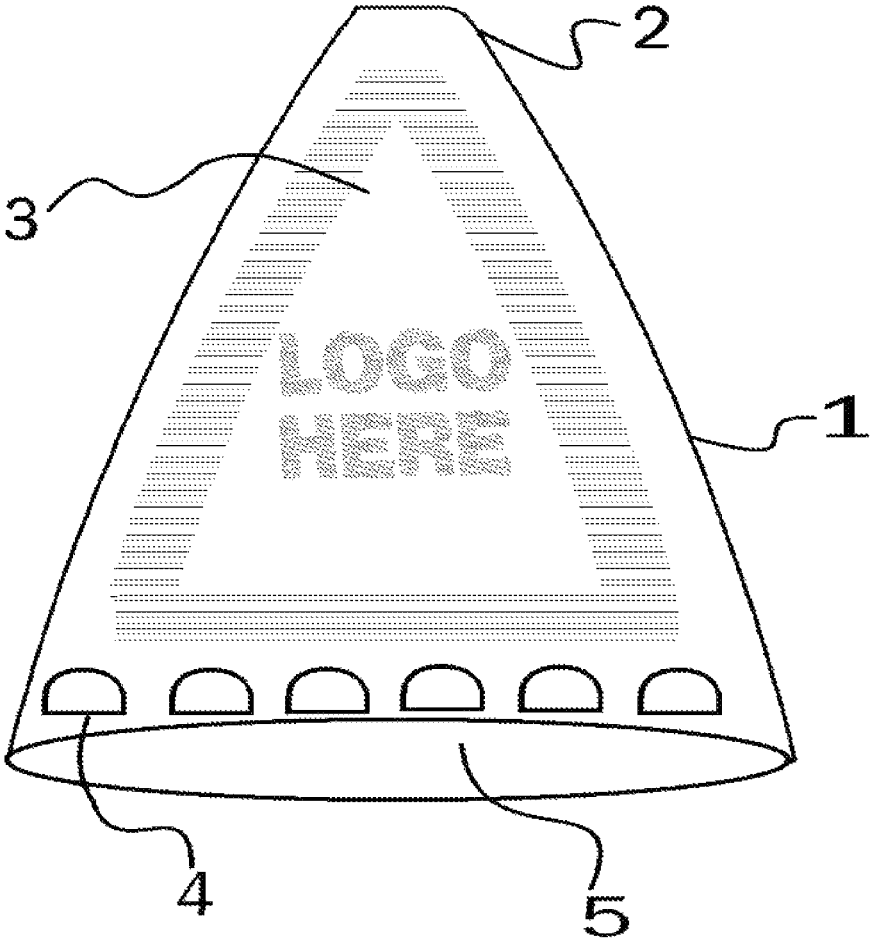
FIG. 1 is a graphic illustration of an embodiment according to the present invention.

FIG. 1 illustrates a boxing/punching bag 1 according to the present invention that includes a body portion defined by a body panel comprising a first edge that forms a first ("top") closed end 2, and comprising a second edge that is distal to the first edge wherein the second edge defines a second ("bottom") opened end 5 of an interior enclosure bounded within interior sidewalls of the body panel between the first closed end 2 and the second opened end 5. It will be understood that "top" and "bottom" descriptors as used to distinguish between the sides are for purposes of illustration only, and that the orientation of the ends 2 or 5 is not determinative of whether the boxing/punching bag 1 is upright.

The boxing/punching bag 1 body further includes airflow vents 4 formed and disposed through the sidewall panels and a brandable center region 3 defined on an outer surface region or area of the sidewall panels.

Figure 2:
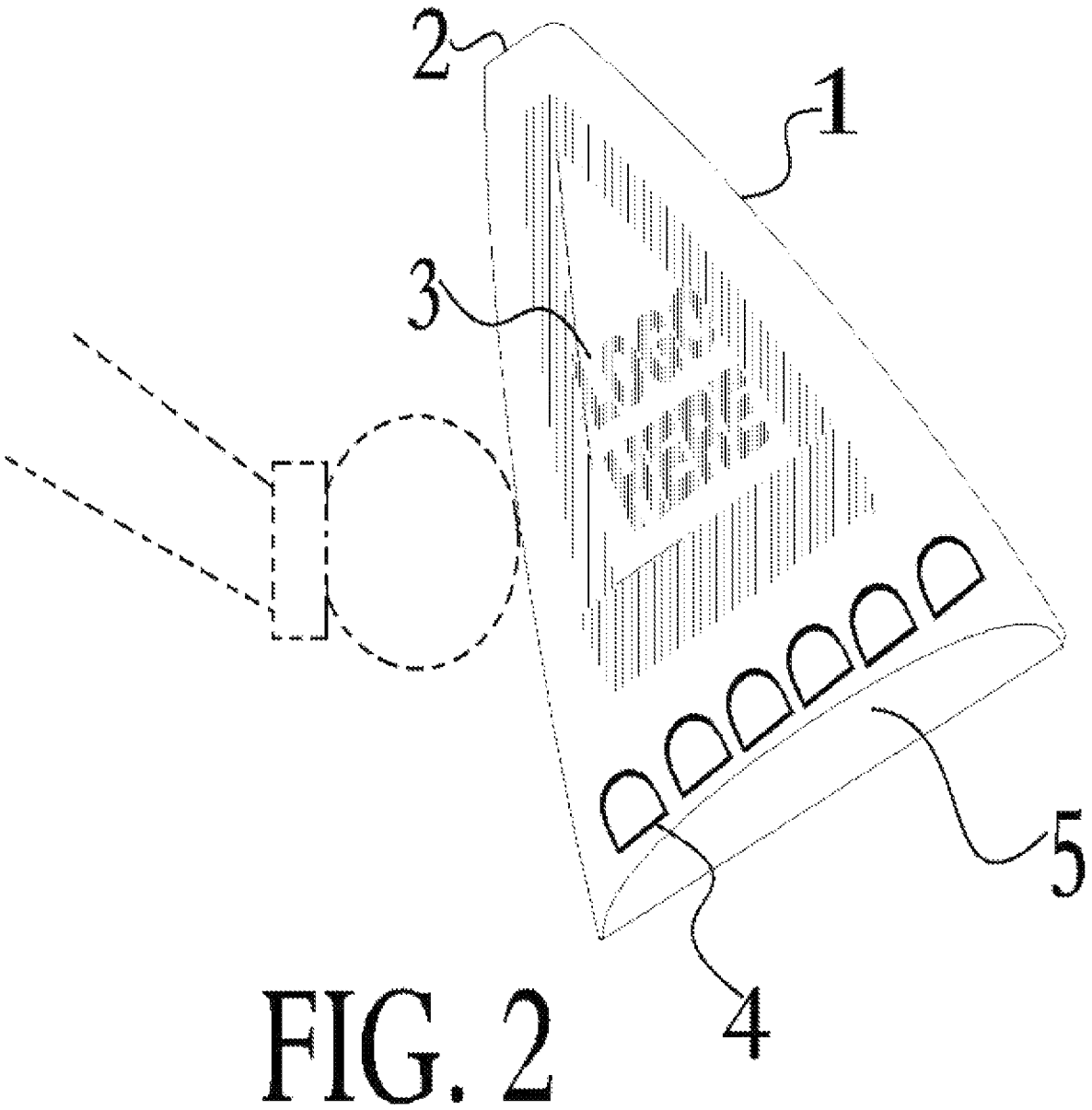
FIG. 2 is another graphic illustration of an embodiment according to the present invention.

FIG. 2 illustrates the boxing/punching bag 1 being struck, wherein the closed top end 2 traps natural air between body panels of the boxing/punching bag 1 located between the ends 2 and 5 while being struck, the natural air admitted into an enclosure region defined between the panels and the closed top end 2 and opening at the opened bottom end 5, the boxing/punching bag 1 enclosure region thereby catching natural air while being struck, and wherein the airflow vents 4 release portions of the trapped air from the enclosure region while being struck. The trapped air interacts with ambient air within an outer area surrounding the boxing/punching bag 1, to thereby slow or impede a falling or rising motion of the boxing/punching bag 1 as it is conveyed through the air in response to punching, throwing or other forces imparted to the boxing/punching bag 1 by a user.

Branding ("Logo Here" text or other text, icon, trademark or other distinctive graphic content) may be displayed within the brandable center region 3 and thereby displayed to viewers while the boxing/punching bag 1 is in use as a training device and/or advertising flyer.

Figure 3:
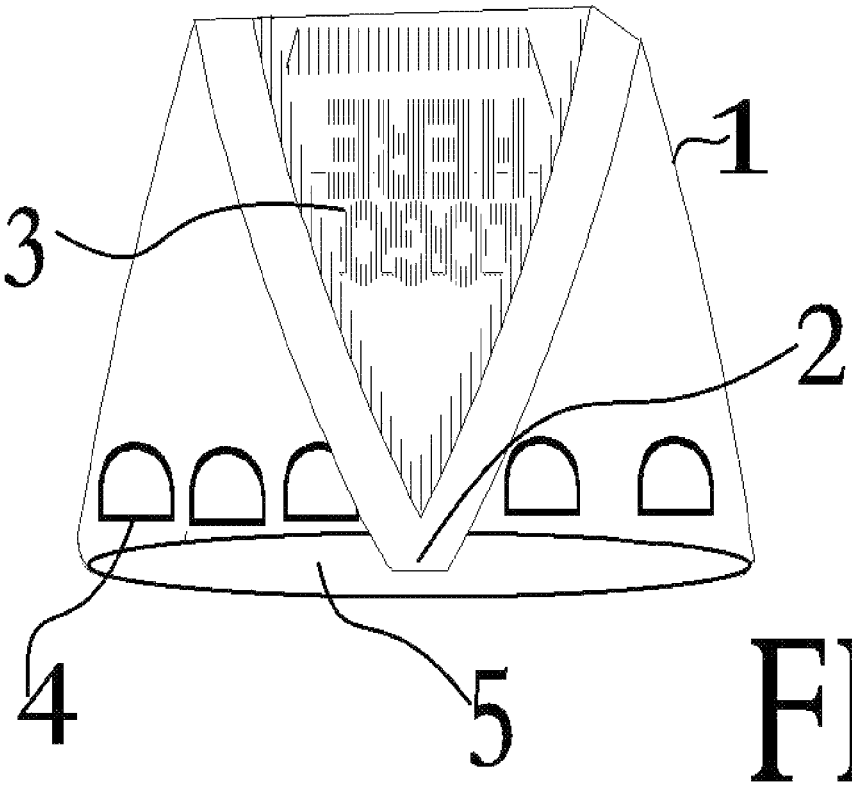
FIG. 3 is another graphic illustration of an embodiment according to the present invention.

FIG. 3 shows the embodiment 1 of FIG. 1 in a folded orientation for easy placement into a user's pocket for easy transport.

Figure 4:
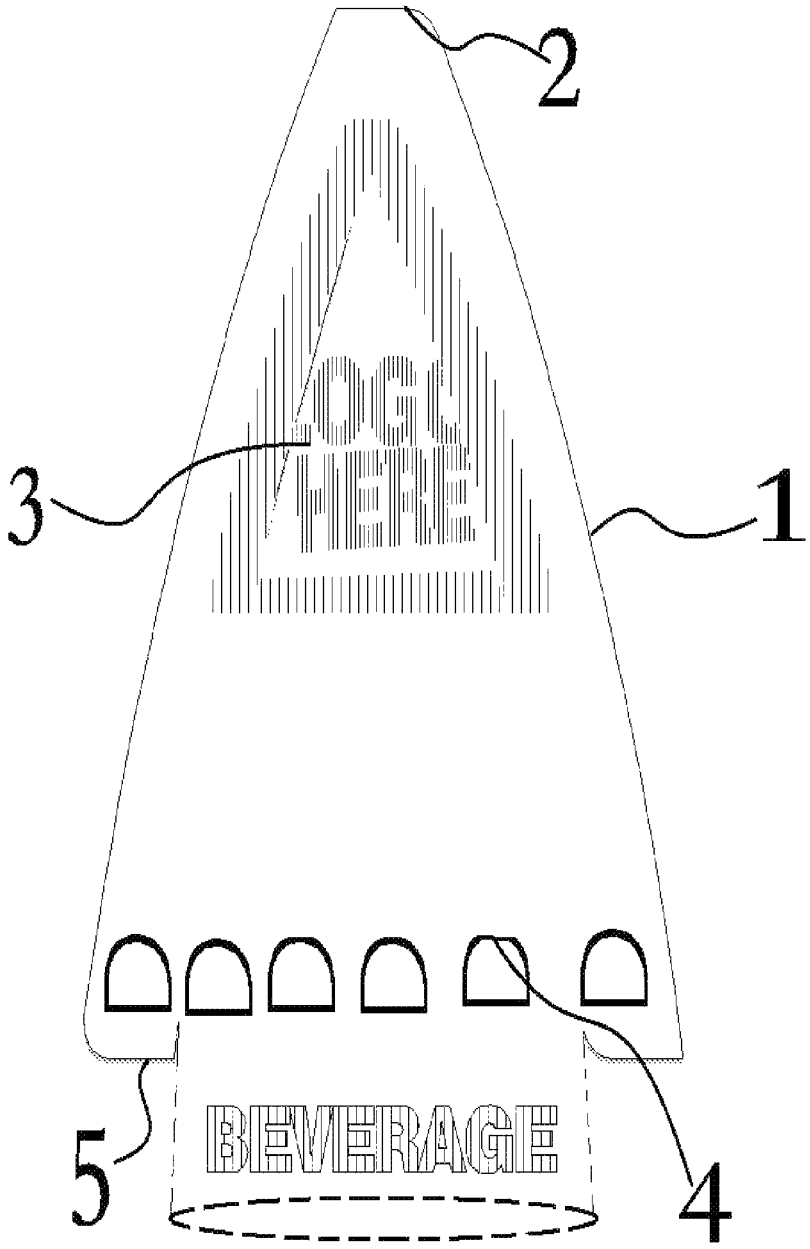
FIG. 4 is another graphic illustration of an embodiment according to the present invention.

FIG. 4 shows deployment of the embodiment 1 when not in use as a training device, for example draped over a beverage or other item and thereby displaying or brandishing a logo, thus in use as an advertising flyer.

Embodiments according to the present invention present advantages over conventional boxing bag articles and methods. For example, embodiments of the boxing/punching bag 1 do not need attachments to be operable; do not require that a user inject the body enclosure region or other portions of the boxing/punching bag 1 with air, water, sand or another medium in order to make the boxing/punching bag 1 operable; do not need pedestals, cords, or pulleys or other additional support elements to render the boxing/punching bag 1 operable; fit into the users pocket in folded or unfolded orientations with ease, providing for easy transport; and provide advertising flyer or other graphic information display functions when in use as a boxing bag, and when not in use for boxing (for example, draped over a beverage or other article, etc.)

Some embodiments of the boxing/punching bag 1 weigh less than 5.5 grams and intake through the opened end 5 from 0.403 to 0.523 cubic feet (cu. ft.) of natural air, which may be released through the opened end 5 and/or the vents 4 within seconds (for example, 3.52, 3.60 or 4.02 seconds).

In one illustrative but not limiting or exhaustive example a length dimension of the boxing/punching bag is 12 inches, and a width dimension is 11 inches, wherein the bottom/opening 5 is 17 inches in width and expands and decreases during use, wherein the body panels are formed from High-Density Polyethylene (HDPE) having a thickness ranging from 0.6 to 0.8 mils. (A "mil" is a measurement unit that equals one-thousandth of an inch (0.001 inch), or 0.0254 millimeters (mm).)

In some embodiments 22 or more of the vents 4 are provided through the body panels for natural airflow into or out of the body enclosure, ranging from 0.75 inches to 0.835 inches in length, and the first end is one inch long. In the present example the boxing/punching bag 1 can be folded into a compact form factor as small as 3 inches by 3 inches and thereby placed into the user's pocket without creating a substantial bulge.

Testing: In testing drop time of embodiments of the boxing/punching bag 1 in an opened space the following was determined: when dropped from eight (8) feet with the closed end 2 facing upward (relative to the downward movement direction of the dropping boxing/punching bag 1) it took 3.60 seconds to hit the ground. In a second drop test with the bottom end 5 instead facing upward, it took 4.02 seconds to completely descend and hit the ground, due to the bottom end 5 opening and the boxing/punching bag swaying back and forth through the air after catching natural airflow. In a third drop test the boxing/punching bag 1 was thrown upward into the air for a distance of eight feet from an initial height of five feet from ground, wherein it took the boxing/punching bag 1 3.52 seconds to completely descend and hit the ground.

The terminology used herein is for describing particular aspects only and is not intended to be limiting of the invention. As used herein, the singular forms "a", "an" and "the" are intended to include the plural forms as well, unless the context clearly indicates otherwise. It will be further understood that the terms "include" and "including" when used in this specification, specify the presence of stated features, integers, steps, operations, elements, and/or components, but do not preclude the presence or addition of one or more other features, integers, steps, operations, elements, components, and/or groups thereof. Certain examples and elements described in the present specification, including in the claims and as illustrated in the figures, may be distinguished or otherwise identified from others by unique adjectives (e.g. a "first" element distinguished from another "second" or "third" of a plurality of elements, a "primary" distinguished from a "secondary" one or "another" item, etc.) Such identifying adjectives are generally used to reduce confusion or uncertainty, and are not to be construed to limit the claims to any specific illustrated element or embodiment, or to imply any precedence, ordering or ranking of any claim elements, limitations or process steps.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. An article, consisting of:

a punching bag formed by a body panel;

a first edge of the body panel that forms a first closed end;

a second edge of the body panel that is distal to the first edge, wherein the second edge defines a second opened end of an interior enclosure of the punching bag that is bounded within interior surface sidewalls of the body panel between the first closed end and the second opened end; and a plurality of airflow vents formed near the second edge and disposed through the body panel and configured to transmit air between the interior enclosure and ambient air within an outer area surrounding the body panel;

wherein the first closed end traps air within the interior enclosure that is configured to interact via the second opened end and the plurality of airflow vents with ambient air within an outer area surrounding the body panel, wherein the plurality of airflow vents modify a speed of motion of the punching bag as it is conveyed through the ambient air to thereby render the body panel operable, without attachment of a support element to the body panel, to slow a motion of the punching bag as it is conveyed through the ambient air in response to forces imparted to the body panel by a user.

2. The article of claim 1, wherein the imparted forces are punching or throwing forces.

3. The punching bag of claim 2, wherein the airflow vents are configured to release portions of air trapped within the interior enclosure from the interior enclosure in response to a user punching the body panel while being struck.

4. The article of claim 3, wherein the body panel is formed from a flexible material configured to enable the punching bag to be folded into a pocket-sized form factor.

5. The article of claim 4, wherein the body panel is formed from a High-Density Polyethylene and has a thickness ranging from 0.6 to 0.8 mils.

6. The article of claim 5, wherein the punching bag has a weight that is less than 5.5 grams.

7. The article of claim 6, wherein the interior enclosure has a volume ranging from 0.403 to 0.523 cubic feet of natural air;

wherein the body panel has a length dimension of 12 inches, the first closed end is one inch in length, and an opening formed by the second opened end is 17 inches in width;

wherein the plurality of airflow vents each define openings ranging from 0.75 inches to 0.835 inches in length; and wherein the pocket-sized form factor is a square that is 3 inches by 3 inches.

8. The article of claim 7, wherein the plurality of airflow vents consists of twenty-two of the airflow vents.

* * * * *